US007494319B1

(12) United States Patent
Liang

(10) Patent No.: US 7,494,319 B1
(45) Date of Patent: Feb. 24, 2009

(54) TURBINE BLADE TIP CONFIGURATION

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 404 days.

(21) Appl. No.: 11/510,141

(22) Filed: Aug. 25, 2006

(51) Int. Cl.
*F01D 5/18* (2006.01)

(52) U.S. Cl. ..... 416/92; 416/97 R

(58) Field of Classification Search ..... 416/92, 416/96 R, 97 R; 415/173.1, 173.6
See application file for complete search history.

(56) References Cited

U.S. PATENT DOCUMENTS 6,059,530 A 5/2000 Lee
6,231,307 B1 5/2001 Correia
6,527,514 B2 3/2003 Roeloffs
6,602,052 B2 8/2003 Liang
6,790,005 B2 * 9/2004 Lee et al. ..... 416/97 R
6,991,430 B2 1/2006 Stec et al.
6,994,514 B2 * 2/2006 Soechting et al. ..... 415/115
7,351,035 B2 * 4/2008 Deschamps et al. ..... 416/92

* cited by examiner

*Primary Examiner*—Ninh H Nguyen
(74) *Attorney, Agent, or Firm*—John Ryznic

(57) ABSTRACT

A turbine blade with a squealer tip, the squealer tip being formed by a tip rail extending along the suction side wall of the blade from a point just passed the leading edge of the tip to the trailing edge of the blade, and the tip floor being slanted from the tip rail downward to the pressure side wall of the blade. A first cooling hole opens onto the tip floor at a location adjacent to the pressure side wall of the tip rail, the wall being concave in shape to redirect the flow along the curvature toward the pressure side. A second cooling hole located on the pressure side wall and slanted upward injects cooling air to push the hot gas flow up and over the tip floor. In a second embodiment, the tip floor includes a deflector upstream from and adjacent to the first cooling hole to push the flow upward from the first cooling hole.

14 Claims, 3 Drawing Sheets

TURBINE BLADE TIP CONFIGURATION

CROSS-REFERENCE TO RELATED APPLICATIONS

This application is related to a pending U.S. patent application Ser. No. 11/453,432 filed on Jun. 14, 2006 by Liang and entitled TURBINE BLADE WITH COOLED TIP RAIL.

BACKGROUND OF THE INVENTION

1. Field of the Invention

The present invention relates generally to fluid reaction surfaces, and more specifically to a turbine airfoil tip with cooling.

2. Description of the Related Art Including Information Disclosed Under 37 CFR 1.97 and 1.98

A gas turbine engine uses a compressor that produces a compressed air fed into a combustor and burned with a fuel to produce a hit gas flow. This hot gas flow is passed through a turbine which progressively reduces the temperature of the hot gas flow and converts the energy into mechanical work by driving the turbine shaft. Designers are continuously looking for ways to improve the engine performance. Raising the temperature of the hot gas will increase the efficiency of the engine. However, the temperature is limited to the material properties of the first stage vane and blade assembly. Designers have come up with complex cooling passages for cooling these critical parts in order to allow for the hot gas flow temperature to exceed the melting temperatures of these parts.

Another way to improve the performance of the engine is to reduce the leakage flow between the rotor blade tip and the outer shroud that forms a seal with the tip. Because the engine cycles through temperatures, the tip clearance varies. Sometimes, the tip touches against the shroud, causing rubbing to occur. Rubbing can damage the blade tips. Providing a larger tip clearance will reduce the chance of rubbing, but will also allow for more hot gas flow to leak across the gap and expose the blade cap to extreme high temperature. Cooling of the blade tip is required to limit thermal damage. Separate blade tip cooling passages have been proposed.

Designers have proposed using a squealer tip rail to reduce the blade tip leakage and also provide for rubbing capability for the blade. A squealer tip provides for a thin rail extending from the blade top to form the seal between the shroud. The tip rail is thin and therefore does not provide much surface area against the shroud when rubbing occurs. Thus, with a squealer tip, the effect of rubbing is minimized. FIG. 1 shows a prior art blade with a squealer tip cooling arrangement. The blade has a pressure side 12, a suction side 13, and a top 14 with a tip rail 15 extending along the top edge from the trailing edge around the leading edge before stopping short of the trailing edge on the pressure side 12. Film cooling holes 17 on the pressure side 12 and tip cooling holes 16 on the top provide cooling air for the blade. The squealer tip is formed by the tip rail 15. Secondary leakage flow 21 over the tip is shown and turns into a vortex flow 22 on the blade suction side 13.

FIG. 2 shows a prior art blade with a cooling arrangement for the suction side 13 with a tip rail 15. Suction side tip peripheral film cooling holes 18 are arranged along the suction side near the tip 15. A very hot gas vortex flow 23 is created by the tip configuration on the suction side toward the trailing edge. The suction side blade tip rail 15 is subject to heating from three exposed sides, and therefore cooling of the suction side squealer tip rail 15 by means of discharge row film cooling holes along the blade pressure side peripheral and at the bottom of the squealer floor becomes insufficient. The is primarily due to the combination of tip rail geometry and the interaction of hot gas secondary flow mixing. The effectiveness induced by the pressure side film cooling and tip section convective cooling holes is very limited.

It is therefore an object of the present invention to provide improved blade tip cooling in order improve engine efficiency and increase part life of the blade and shroud.

BRIEF SUMMARY OF THE INVENTION

A squealer tip design for a turbine blade includes a tip rail extending from the leading edge and around the suction side of the blade ending at the trailing edge. The blade top is slanted toward the pressure side wall. A cooling hole on the pressure side slanting toward the top pushes the hot gas flow over the blade tip. The slanted top funnels the hot gas flow toward the rip rail. A cooling hole discharges cooling air from the blade cavity to a point just upstream from the tip rail into a secondary flow deflector to push the hot gas flow through a reduced vena contractor formed between the tip rail and the shroud. In an additional embodiment, a deflector is positioned just upstream of the cooling hole upstream of the tip rail to direct the hot gas flow into the reduced vena contractor of the gap.

DETAILED DESCRIPTION OF THE INVENTION

Figure 1:
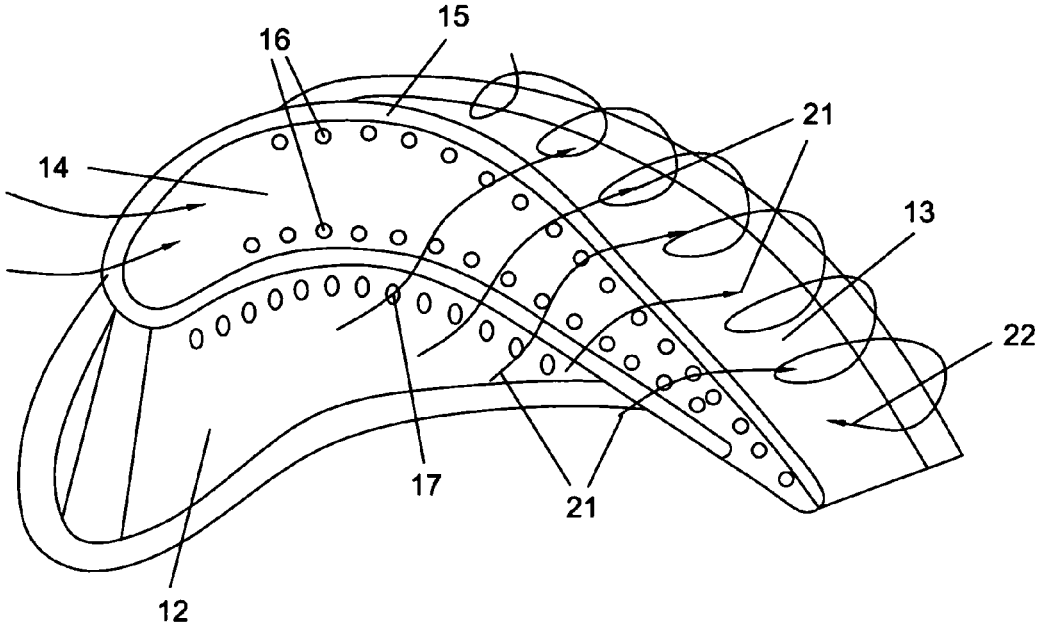
Fig 1 Prior Art
FIG. 1 shows a schematic view of a prior art blade from the top with the flow over the squealer tip.
Figure 2:
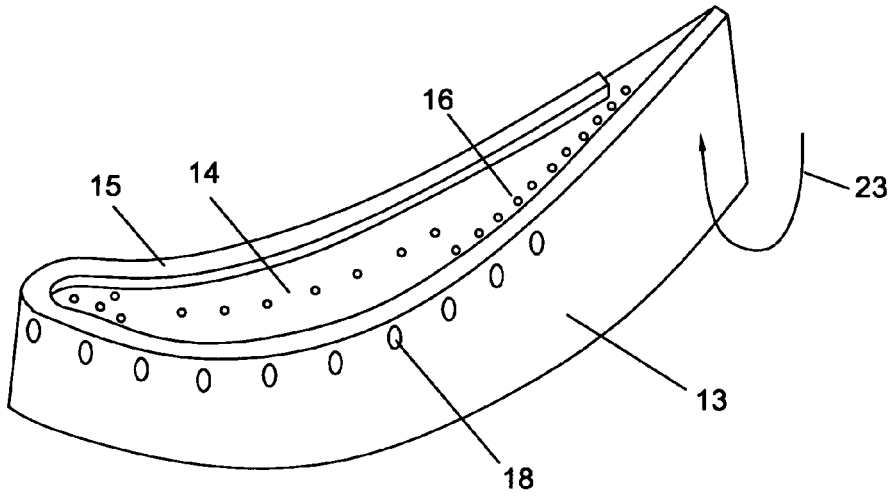
Fig 2 Prior Art
FIG. 2 shows a schematic view of a prior art blade from the suction side looking at the squealer tip.
Figure 3:
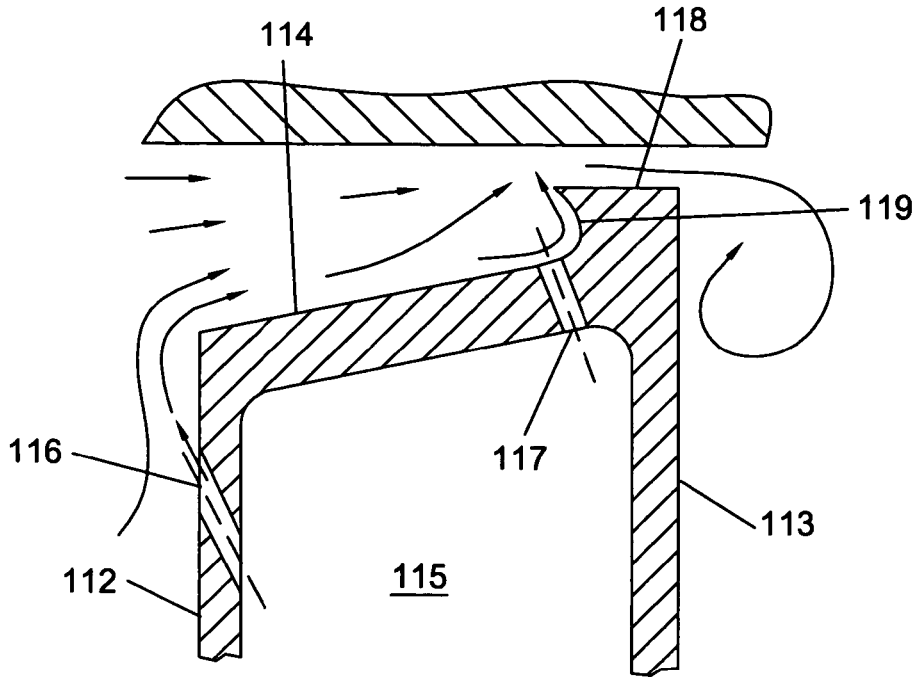
FIG. 3 shows a cross section view of the squealer tip of the present invention.
Figure 4:
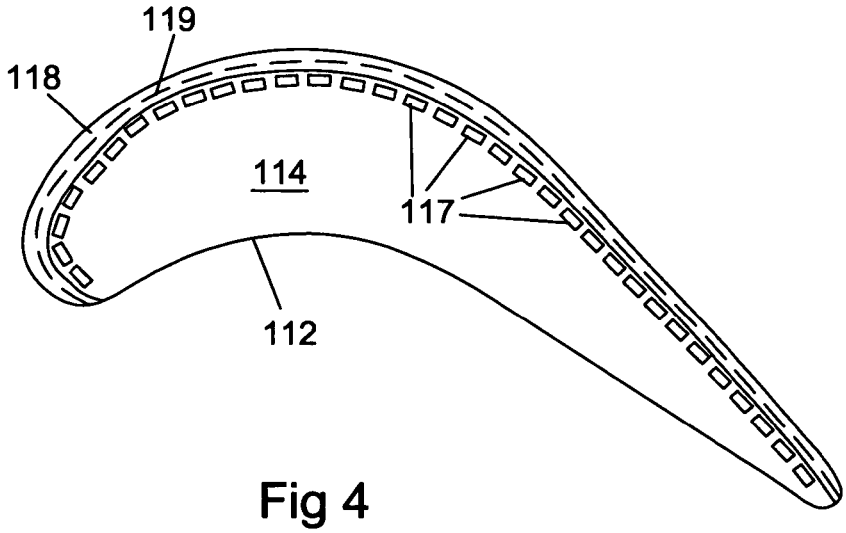
FIG. 4 shows a top view of the squealer tip of the present invention.

The blade for a gas turbine engine of the present invention includes a squealer tip which is shown in FIG. 3. The blade includes a pressure side wall 112 and a suction side wall 113, with a blade tip floor 114 enclosing a cooling channel 115 that supplies cooling air to the various film cooling holes. A pressure side wall cooling diffusion hole 116 discharges cooling air from the cooling channel 115 onto the wall of the blade. The cooling air discharge from diffusion cooing hole 116 pushes the hot gas flow up and over the tip cap or floor 114. The tip floor 114 is slanted toward the pressure side wall 112. A tip rail 118 extends from the leading edge of the blade, around the suction side wall 113, and ending at the trailing edge of the blade as shown in FIG. 4. A tip floor cooling hole 117 opens onto the floor 114 of the tip just upstream from the tip rail 118. The tip rail 118 includes a curved surface 119 on the upstream side of the tip rail. The diffusion cooling holes 117 on the tip floor 114 extends along the tip rail as shown in FIG. 4. The tip rail 118 includes a flat surface that forms the seal and gap with the outer shroud.

In operation, because of the pressure gradient across the airfoil from the pressure side 112 to the suction side 113, the secondary flow near the pressure side surface is migrated from lower blade span upward across the blade end tip 118. On the pressure side corner of the airfoil, the secondary leakage flow entering the squealer pocket acts like a developing flow at low heat transfer rate. Since the floor 114 of the squealer tip is at an offset angle from the blade conical flow path, the secondary leakage flow will be accelerated across the blade tip. This enables the injected film cooling flow from the blade pressure side peripheral as well as injected cooling flow at the leading edge of the squealer floor to establish a well formed film sub-boundary layer over the blade tip surface, and therefore provides for a good film cooling for the floor 114 of the blade tip.

With the offset squealer tip floor 114, the film cooling flow injected from the airfoil pressure side wall through hole 116 and from the top of the pressure side tip through hole 117 will push the near wall secondary leakage flow outward and against the oncoming stream-wise leakage flow first. The combination of the blade leakage flow and the pressure side injection film flow is then pushed upward by the cooling flow injected on the upstream side of the suction side tip rail through hole 117 prior to entering the suction side tip rail squealer channel. In addition to the counter flow action, the forward slanted blade end tip geometry forces the secondary flow to bend outward as the leakage enters the pressure side tip corner and yields a smaller vena contractor (gap formed between the tip rail and the shroud), and therefore reduces the effective leakage flow area.

The creation of the enhanced film cooling geometry plus the leakage flow resistance by the suction side blade end tip geometry and cooling flow injection yields a very high resistance for the leakage flow path and therefore reduces the blade leakage flow and improves blade tip section cooling. Consequently, it reduces the blade tip section cooling flow requirement.

Figure 5:
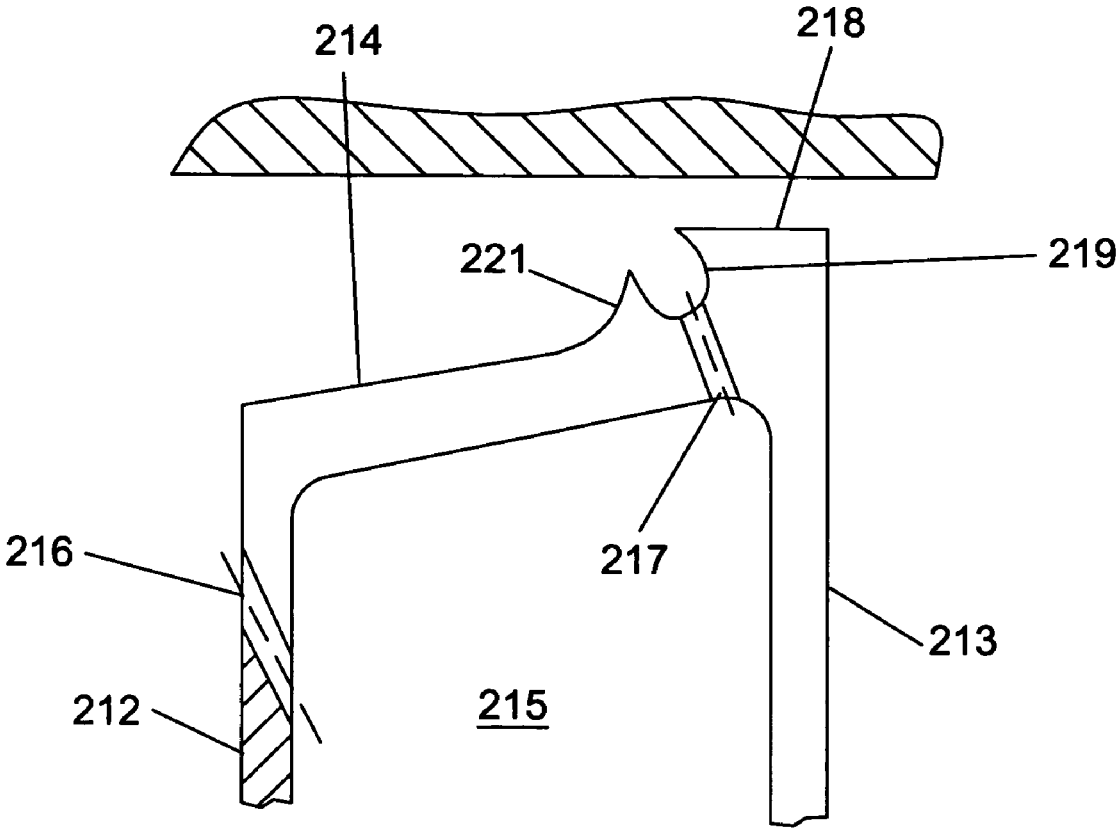
FIG. 5 shows a cross section view of a second embodiment of the squealer tip of the present invention.

A second embodiment of the squealer tip of the present invention is shown in FIG. 5. A curved surface on the slanted tip floor 214 forms a projection 221 upstream of the cooling hole 217. This curved projection 221 acts as a deflector for the cooling air of the hole 217. The cooling air will be diffused within the diffuser 219 which induce a cooling flow curtain effect for the tip rail 218 and also injected at a much closer distance to the blade end tip corner, therefore yielding more effective cooling and sealing for the blade tip.

The present invention provides for an improved squealer tip over the prior art. The blade cooling is more effective and the blade tip sealing is improved. The cooling air trapping cavity for the suction side tip rail geometry combines with the radial convective cooling holes along the tip rail to form a cooling pocket which creates cooling vortex and traps the cooling flow longer. This provides for better cooing for the tip rail and the blade squealer pocket floor.

I claim the following:

1. A turbine blade with a squealer tip, comprising:

A pressure side wall and a suction side wall;

A tip floor forming a cooling supply channel;

A tip rail extending along the suction side wall of the blade from substantially the leading edge to the trailing edge of the tip; and, The tip floor slanting downward the suction side wall to the pressure side wall.

2. The turbine blade of claim 1, and further comprising:

A first cooling hole opening onto the tip floor at a location upstream from and adjacent to the tip rail.

3. The turbine blade of claim 2, and further comprising:

The tip rail having a pressure side surface with a substantially concave shape.

4. The turbine blade of claim 3, and further comprising:

A second cooling hole in the pressure side wall slanting toward the tip, the first cooling hole opening on the pressure side surface near to the tip floor.

5. The turbine blade of claim 3, and further comprising:

The tip floor having a deflector located just upstream from the first cooling hole opening onto the tip floor.

6. The turbine blade of claim 3, and further comprising:

The first cooling hole is slanted in a direction toward the pressure side wall, the first cooling hole being slanted at an angle substantially equal to the angle at the end of the concave curvature of the tip rail pressure side surface.

7. The turbine blade of claim 6, and further comprising:

A second cooling hole in the pressure side wall slanting toward the tip, the first cooling hole opening on the pressure side wall near to the tip floor; and, The first cooling hole and the second cooling hole slanting at substantially the same angle.

8. The turbine blade of claim 2, and further comprising:

The tip floor slanting downward from the first cooling hole to the pressure side wall.

9. The turbine blade of claim 1, and further comprising:

The tip floor slanting more than 5 degrees and less than 30 degrees.

10. The turbine blade of claim 1, and further comprising:

The tip rail having a substantially flat surface.

11. A turbine blade with a squealer tip to form a seal between the blade and an outer shroud, the blade comprising:

A pressure side wall and a suction side wall;

A tip floor enclosing a cooling supply channel;

A tip rail extending along the suction side wall from a location slightly past the leading edge to a trailing edge;

The tip rail having a pressure side wall with a concave curvature;

A first cooling hole located adjacent to the pressure side wall of the tip rail, the first cooling hole being slanted toward the pressure side wall;

The tip floor extending from the first cooling hole and slanting downward to the pressure side wall, the tip floor slanting at least 5 degrees and no more than 30 degrees; and, A second cooling hole located in the pressure side wall and opening onto the wall near to the tip floor.

12. The turbine blade of claim 11, and further comprising:

A deflector extending from the tip floor and located adjacent to the first cooling hole opening, the tip floor slanting downward from the deflector to the pressure side wall at least 5 degrees and not more than 30 degrees.

13. The turbine blade of claim 11, and further comprising:

The tip rail having a suction side wall that is substantially flush with the suction side wall of the blade.

14. The turbine blade of claim 11, and further comprising:

The curvature of the pressure side wall of the tip rail being such that the flow over the curved surface flows in an opposite direction to the flow over the tip floor.

* * * * *